US007271773B2

(12) United States Patent
Gorai et al.

(10) Patent No.: US 7,271,773 B2
(45) Date of Patent: Sep. 18, 2007

(54) ANTENNA MOUNTED ON VEHICLE

(75) Inventors: Tatsuo Gorai, Gunma (JP); Sadao Ohno, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 37 days.

(21) Appl. No.: 11/252,743

(22) Filed: Oct. 19, 2005

(65) Prior Publication Data

US 2006/0097937 A1 May 11, 2006

(30) Foreign Application Priority Data

Oct. 21, 2004 (JP) ..... P2004-306399

(51) Int. Cl.
*H01Q 1/32* (2006.01)

(52) U.S. Cl. ..... 343/711; 343/713

(58) Field of Classification Search ..... 343/713, 343/711, 715

See application file for complete search history.

(56) References Cited

U.S. PATENT DOCUMENTS 5,757,327 A * 5/1998 Yajima et al. ..... 343/713
6,331,838 B1 * 12/2001 Scott et al. ..... 343/715
6,535,171 B1 * 3/2003 Lauermann et al. ..... 343/715
7,019,701 B2 * 3/2006 Ohno et al. ..... 343/715
2004/0174311 A1 * 9/2004 Kordass et al. ..... 343/711
2006/0071868 A1 * 4/2006 Gorai et al. ..... 343/715
2006/0109186 A1 * 5/2006 Yamada et al. ..... 343/713

FOREIGN PATENT DOCUMENTS

JP A-10-84207 3/1989
JP A-10-084207 3/1998

* cited by examiner

*Primary Examiner*—Tan Ho
(74) *Attorney, Agent, or Firm*—Morgan, Lewis & Bockius LLP

(57) ABSTRACT

In an antenna adapted to be mounted on a vehicle body, a base member supports a base end of the antenna element. A screw member is extended from the base member and adapted to be inserted into a though hole formed in the vehicle body. A wall member is extended from the base member to define a housing space. A circuit board is disposed in the housing space. A casing covers the housing space such that an inner face thereof comes in contact with an outer face of the wall member. A waterproofing member is disposed between the base member and the vehicle body so as to surround an entire periphery of the through hole.

4 Claims, 6 Drawing Sheets

ANTENNA MOUNTED ON VEHICLE

BACKGROUND OF THE INVENTION

The present invention relates to an antenna which is to be mounted on a vehicle, and which is provided with an improved waterproof structure with respect to a circuit board arranged in a base member of the antenna.

An example of the structure of a related-art antenna will be described below with reference to FIGS. 5 and 6. In an upper part of an approximately hat-shaped case 10, a base end of an antenna section 12 is arranged in a pivotable manner. A base member 14 is fixed to a lower end opening face of the case 10 by a screw or the like. A circuit board 16 and the like are arranged in a space formed by the case 10 and the base member 14. A screw 14*a* protruding in a bottom surface of the base member 14 is inserted into a hole 18*a* drilled in the vehicle body 18. A nut which is not shown is engaged from the inside of the vehicle body 18, so that the base member 14 is fixed to the vehicle body 18.

A pad 20 having elasticity is inserted between the base member 14 and the vehicle body 18. In the pad 20, a pad lip 20*a* is provided that surrounds the entire periphery of the hole 18*a* and that protrudes toward the vehicle body 18. When the base member 14 is fixed to the vehicle body 18, the pad lip 20*a* is damped and elastically deformed so as to come close contact with the vehicle body 18. This prevents rain water or the like from entering into the vehicle body 18 through the hole 18*a*. Further, at a lower end edge of the case 10, a case lip 10*a* protruding downward and coming contact with the pad 20 is provided as shown in FIG. 6. When the base member 14 is fixed to the vehicle body 18, the case lip 10*a* comes elastic firm contact with the elastic pad 20, so that a watertight structure is formed between the case 10 and the pad 20. This prevents rain water from entering into the case 10, and hence protects the circuit board 16 arranged in the inner space from being exposed to the rain water.

In the above structure, in order to ensure the watertight structure between the case 10 and the pad 20, the case lip 10 must be brought into contact with the pad 20 firmly. Thus, for the purpose of reinforcement of the pad 20, a reinforcement lip 20*b* is provided on the pad 20 in the side facing the vehicle body 18 and at a position opposing to the case lip 10*a* as shown in FIG. 6. The reinforcement lip 20*b* has a size approximately corresponding to the size of the lower end edge of the case 10. Meanwhile, in general, the vehicle body 18 is composed of gradual complicated curved surfaces. Thus, when the reinforcement lip 20*b* is brought into firm contact with such a vehicle body 18 in a large area, the curved surface of the vehicle body 18 would be deformed undesirably. Thus, the pad 20 has to be designed separately for each type of vehicle body 18 in order to avoid deformation in the curved surface. Nevertheless, separate fabrication of the pad 20 for each vehicle body type is not economical.

Japanese Patent Publication No. 10-84207A also discloses an antenna to be mounted on a vehicle body. In this antenna, a ring-shaped ridge for covering the lower end periphery of the case is provided in the outer periphery of the pad. When the ring-shaped ridge covers the lower end periphery of the case, a watertight structure is formed between the case and the pad.

However, when the pad deforms elastically in correspondence to the curved surface of a vehicle body, the ring-shaped ridge also deforms. Since a pad is brought into elastic contact with a lower end periphery of the case solely by virtue of the elasticity of a ring-shaped ridge of the pad, the above deformation causes a change in the elasticity for establishing elastic contact with the lower end periphery of the case, and thereby may cause insufficient reliability in the watertight structure. Thus, also in this configuration, the pad needs to be fabricated separately for each vehicle body type.

SUMMARY OF THE INVENTION

It is therefore an object of the invention to provide an antenna that will not generate deformation in the curved surface of a vehicle body on which the antenna is mounted, while achieving reliable waterproofness.

In order to achieve the above object, according to the invention, there is provided an antenna adapted to be mounted on a vehicle body, comprising:

an antenna element;

a base member, supporting a base end of the antenna element;

a screw member, extended from the base member and adapted to be inserted into a though hole formed in the vehicle body;

a wall member, extended from the base member to define a housing space;

a circuit board, disposed in the housing space;

a casing, covering the housing space such that an inner face thereof comes in contact with an outer face of the wall member; and a waterproofing member, disposed between the base member and the vehicle body so as to surround an entire periphery of the through hole.

With this configuration, even when a small amount of rain water enters into the inside from an edge portion of the casing, the wall member prevents the rain water from entering into the housing space, and hence prevents the circuit board from being exposed to the rain water. Therefore, what is necessary to prevent the rain water from entering into the vehicle body through the through hole is to bring the waterproof member surrounding the through hole into firm contact with the vehicle body in a small area. This avoids deformation in the complicated curved surface of the vehicle body.

The antenna may further comprise an elastic pad disposed between the base member and the vehicle body, and monolithically formed with a lip member serving as the waterproofing member.

In this case, the number of necessary components can be reduced. Further, a pad having one shape can be applied to a larger number of vehicle body types without generating deformation in the curved surface of the vehicle. This permits mass production, and hence is economical.

The antenna may further comprise a feeding terminal, extended from the base member so as to penetrate the circuit board disposed in the housing space, and electrically connected to the antenna element.

In this case, the circuit board is arranged in the housing space and penetrated by the feeding terminal. This achieves reliable electric connection between the feeding terminal and the circuit board. Further, the work of establishing the electric connection between the feeding terminal to the circuit board and the work of arranging the circuit board in the housing space can be performed easily and reliably in a single work step.

The base member may be comprised of metal, and the wall member may be comprised of resin and integrally molded with the base member.

In this case, the waterproofness with respect to the circuit board can be enhanced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Figure 1:
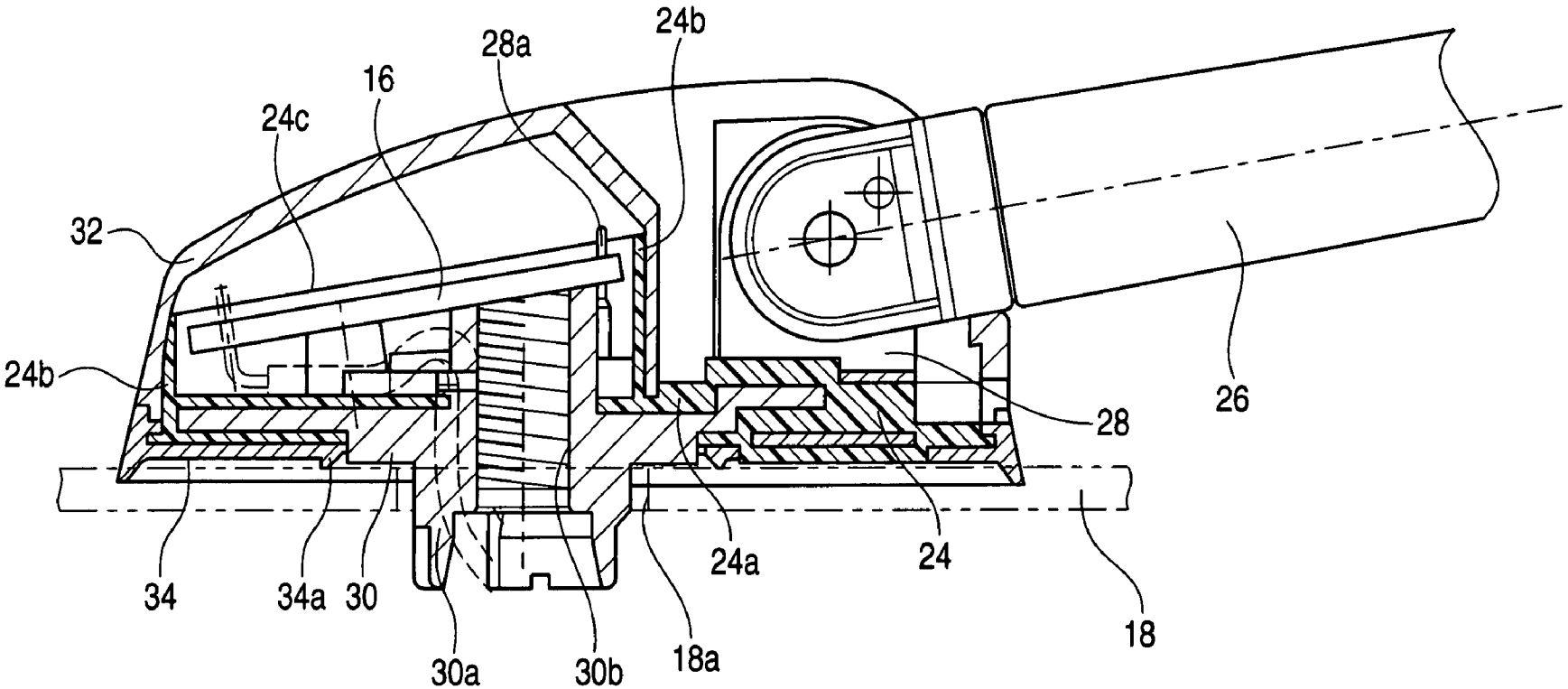
FIG. 1 is a section view of an antenna according to one embodiment of the invention.
Figure 2A:
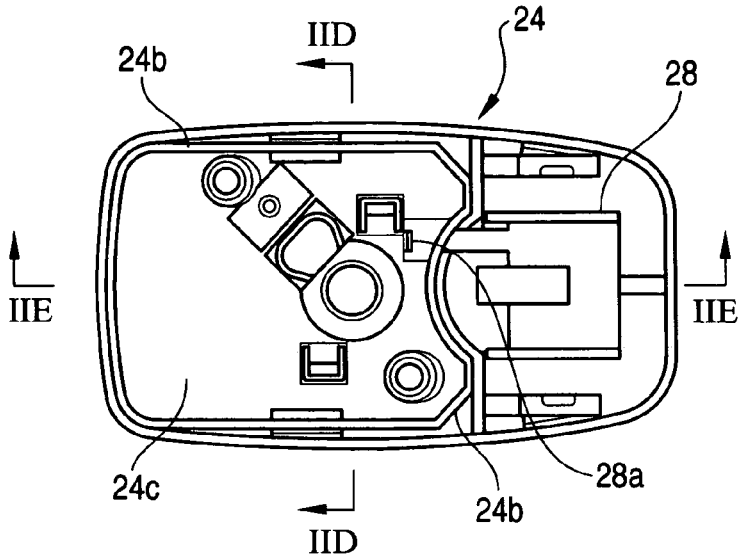
FIG. 2A is a top view of an antenna base in the antenna.
Figure 2B:
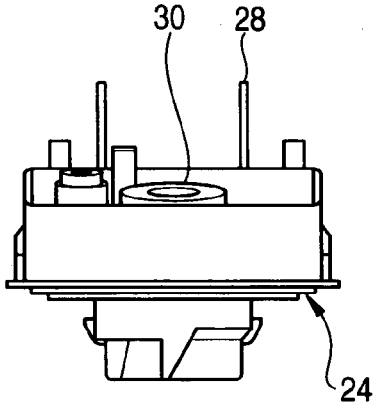
FIG. 2B is a front view of the antenna base in the antenna.
Figure 2C:
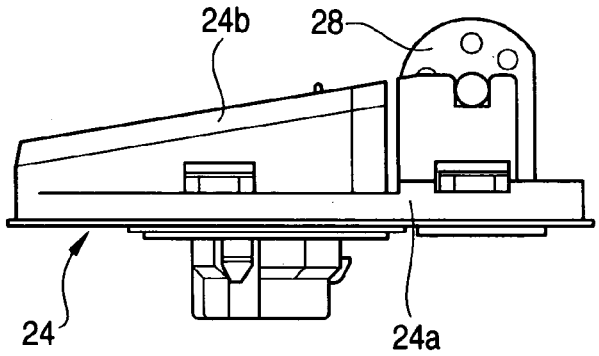
FIG. 2C is a side view of the antenna base in the antenna.
Figure 2D:
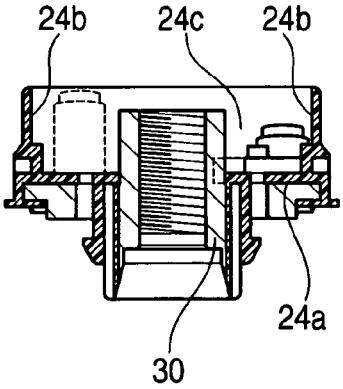
FIG. 2D is a section view taken along a line IID-IID in FIG. 2A.
Figure 2E:
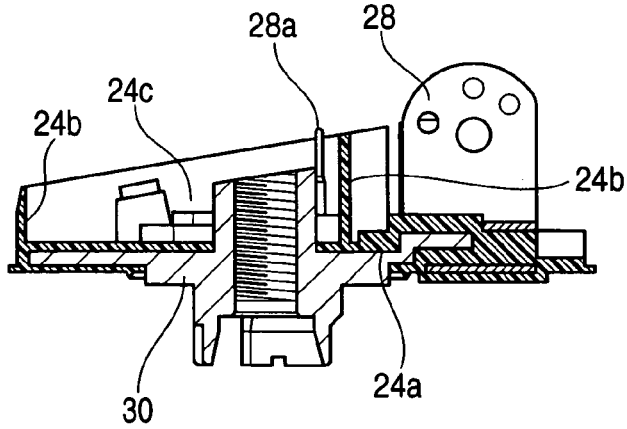
FIG. 2E is a section view taken along a line IIE-IIE in FIG. 2A.
Figure 3A:
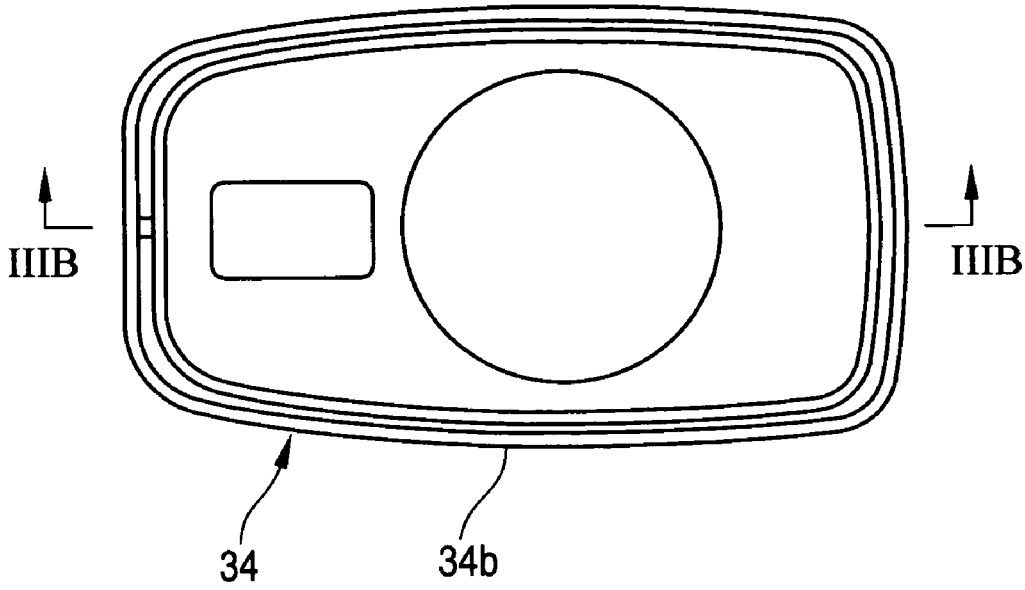
FIG. 3A is a top view of a pad in the antenna.
Figure 3B:
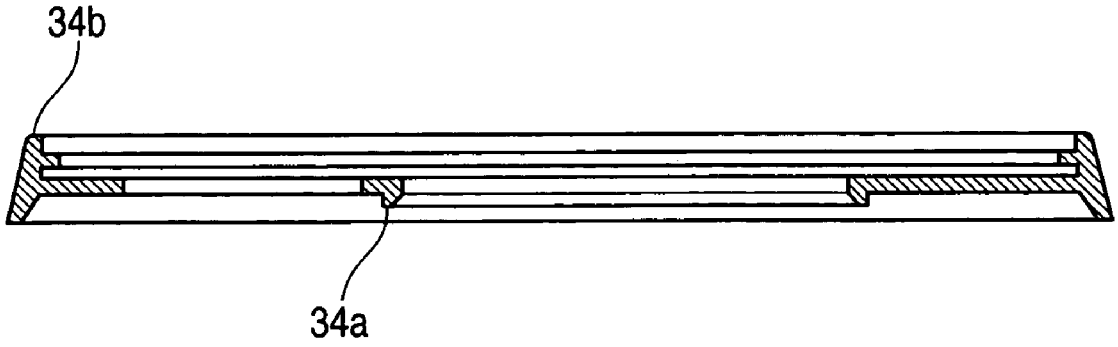
FIG. 3B is a section view taken along a line IIIB-IIIB in FIG. 3A.

Embodiments of the invention will be described with reference to the accompanying drawings.

FIGS. 1 through 4 show an antenna to be mounted on a vehicle body 18, according to one embodiment of the invention. In this antenna, a base member 24 is provided with a metallic base plate 28 for supporting a base end of an antenna section 26 in a pivotable manner, and a metallic base 30 for fixing the base member 24 to a vehicle body 18, where the base plate 28 and the base 30 are formed integrally by resin-molding. In this resin-molded part 24*a*, a wall 24*b* is vertically formed by also integral molding to surround the entire periphery of the part 24*a*, thereby forming a housing section 24*c* having an opening solely on top.

Further, a feeding terminal 28*a* formed integrally with the base plate 28 is arranged in a manner penetrating the wall 24*b* in a watertight structure and then protruding upward inside the housing section 24*c*. Then, the housing section 24*c* in which a circuit board 16 is arranged and the base plate 28 in which a base end of the antenna section 26 is arranged are disposed in positions aligned horizontally, so that they do not vertically overlap with each other. With this configuration, the circuit board 16 can be arranged without interference from the attachment of the antenna section 26. Further, the electric connection to the feeding terminal 28*a* of the circuit board 16 can be checked visually. Specifically, the base plate 28 is electrically connected to a base end of an unshown antenna element of the antenna section 26, so that electric conduction is established between the feeding terminal 28*a* and the antenna element.

The base 30 is provided with a boss section 30*a* which can be inserted into an hole 18*a* drilled in the vehicle body 18. A female screw 30*b* is engraved vertically at the center of the boss section 30*a*.

Figure 4:
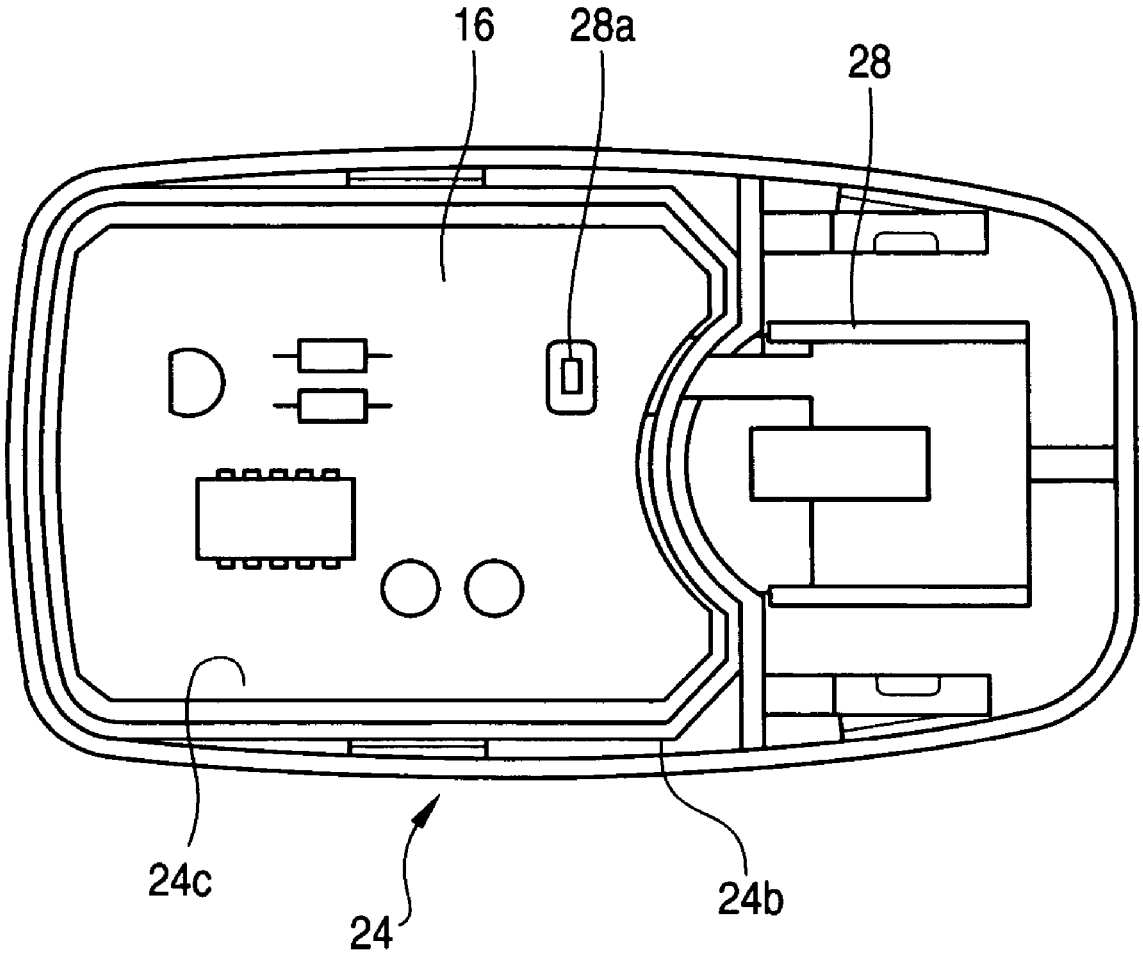
FIG. 4 is a top view of the antenna base, showing a state that a circuit board is installed thereon.

In this base member 24, the circuit board 16 is arranged and fixed into the housing section 24*c* from above as shown in FIG. 4. Further, the feeding terminal 28*a* is inserted through a hole drilled in a feeding section of the circuit board 16. Then, soldering is performed appropriately so that electric conduction is established. Further, the antenna section 26 is arranged in the base plate 28. Here, since the arrangement positions of the circuit board 16 and the antenna section 26 do not vertically overlap with each other, no problem arises in the order of assembling of these components. Further, a case 32 is placed so as to cover the housing section 24*c* from above. Then, the case 32 is fixed to the base member 24 with a screw or the like inserted upward from the lower end face of the base member 24. Here, the case 32 is formed so as to cover the entire outer periphery of the wall 24*b* that forms the housing section 24*c*. Further, their dimensions are preferably configured such that the inner wall face of the cover case 32 covers and comes in contact with the outside of the wall 24*b* without a gap.

Further, a pad 34 composed of elastic material such as rubber is arranged in the lower end face of the base member 24. The pad 34 is provided with a monolithically-formed pad lip 34*a* that protrudes downward to surround the entire periphery of the hole 18*a* of the vehicle body 18. Further, the outer periphery edge of the pad 34 is provided with a ring-shaped ridge 34*b* arranged so as to surround the lower end outer surface of the case 32. Here, the lower end face of the case 32 is brought into light contact with the pad 34.

When the antenna having this configuration is attached and fixed to the vehicle body 18, the boss 30*a* is inserted into the hole 18*a* of the vehicle body 18, while a screw (not shown) is inserted into and engaged with the female screw 30*b* of the boss section 30*a* from the inside of the car, and then tightened and fixed. When the screw is tightened, the pad 34 clamped between the base member 24 and the vehicle body 18 is compressed so that the pad lip 34*a* elastically deforms and thereby coming in close contact with the vehicle body 18. As a result, a watertight structure is formed. On the other hand, the lower end edge of the case 32 does not come in elastic contact with the pad 34. Thus, it is sufficient that the ring-shaped ridge 34*b* of the pad 34 deforms appropriately in correspondence to the curved surface of the vehicle body 18.

In this configuration, even when a small amount of rain water enters into the case 32 from a contact part between the lower end edge of the case 32 and the pad 34, the wall 24*b* provided in the base member 24 prevents the rain water from entering into the housing section 24*c*. This avoids a possibility that the circuit board 16 is exposed to the rain water. Further, since the pad lip 34*a* of the pad 34 elastically contacts closely with the vehicle body 18, the rain water is prevented from entering into the vehicle body through the hole 18*a*. Further, the size of the pad lip 34*a* can be made so small that is merely sufficient for surrounding the entire periphery of the hole 18*a*. Thus, this minimizes the area in which the pad lip 34*a* is brought into firm contact with the vehicle body having the complicated curved surface, and therefore avoids deformation in the complicated curved surface of the vehicle body 18.

Figure 5:
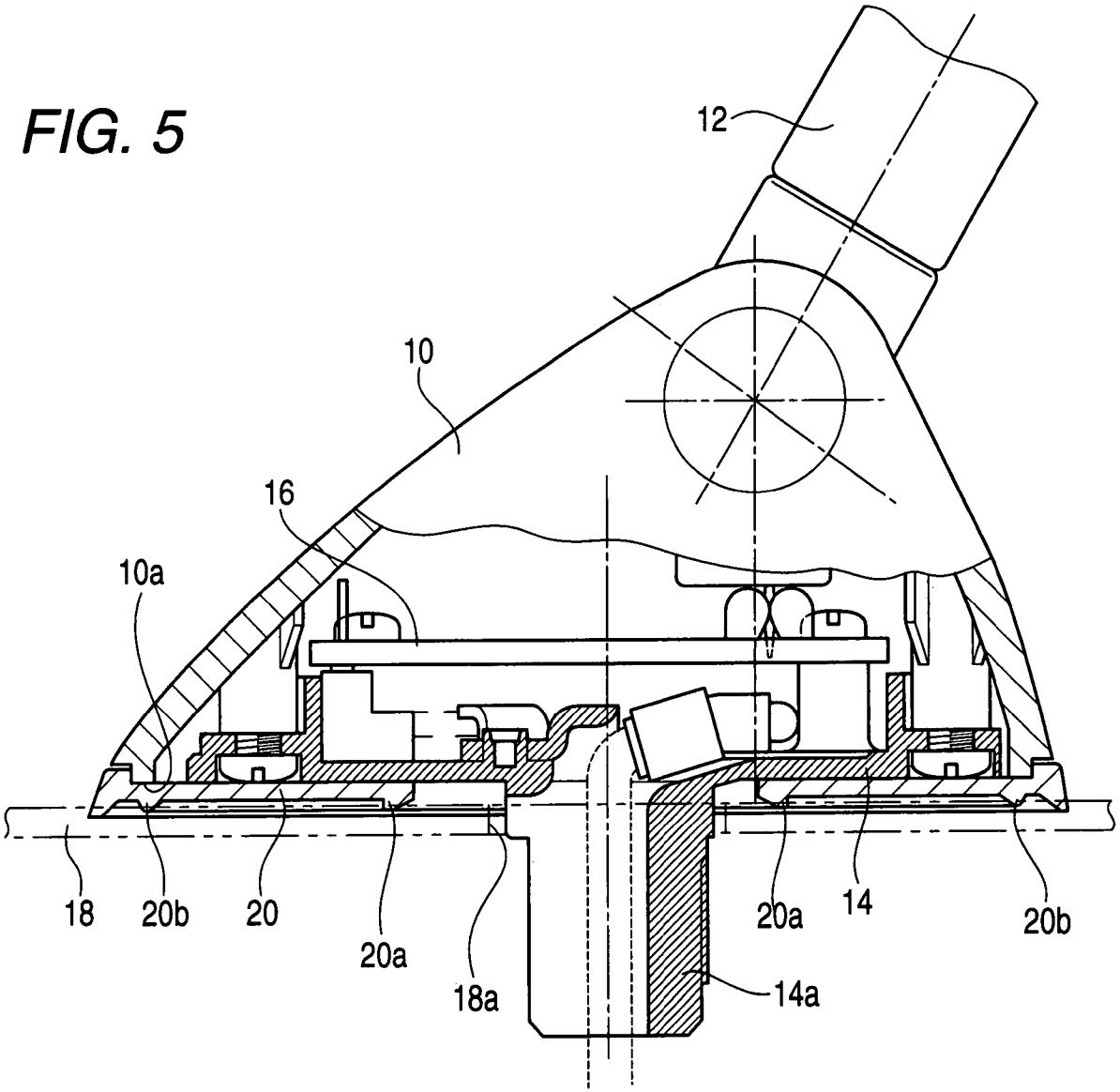
FIG. 5 is a partial section view of a related-art antenna.
Figure 6:
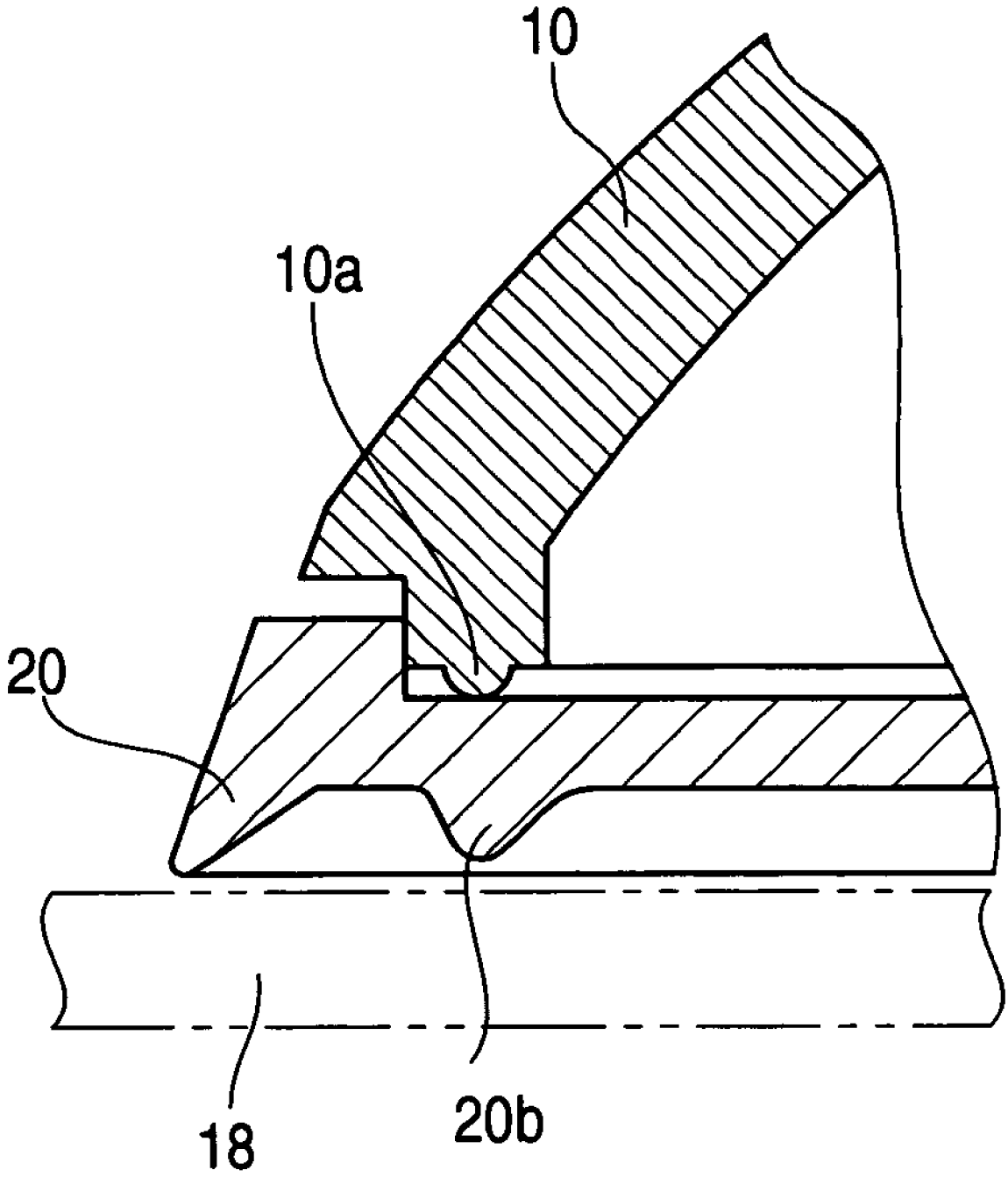
FIG. 6 is an enlarged section view of a peripheral edge portion of the related-art antenna.

In this embodiment, the female screw 30*b* is provided in the base member 24, and the attaching screw is inserted from the inside of the vehicle body 18 and then tightened. However, the screw may be provided in the base member 24 similarly to the related-art configuration shown in FIG. 5. Although the housing section 24*c* and the base plate 28 are aligned horizontally in this embodiment, the base plate 28 may be arranged appropriately so as to be overlaid on the housing section 24*c* provided with the circuit board 16 as in the related-art configuration. The pivotable antenna section 26 in this embodiment may be replaced with a fixed antenna section. Although the pad lip 34*a* in this embodiment is monolithically formed with the pad 34, an O-ring surrounding the entire periphery of the hole 18 may be used as the waterproof member in place of the pad lip 34.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An antenna adapted to be mounted on a vehicle body, comprising:

an antenna element;

a base member, supporting a base end of the antenna element;

a screw member, extended from the base member and adapted to be inserted into a though hole formed in the vehicle body;

a wall member, extended from the base member to define a housing space;

a circuit board, disposed in the housing space;

a casing, covering the housing space such that an inner face thereof comes in contact with an outer face of the wall member; and a waterproofing member, disposed between the base member and the vehicle body so as to surround an entire periphery of the through hole.

2. The antenna as set forth in claim 1, further comprising an elastic pad disposed between the base member and the vehicle body, and monolithically formed with a lip member serving as the waterproofing member.

3. The antenna as set forth in claim 1, further comprising a feeding terminal, extended from the base member so as to penetrate the circuit board disposed in the housing space, and electrically connected to the antenna element.

4. The antenna as set forth in claim 1, wherein;

the base member is comprised of metal; and the wall member is comprised of resin and integrally molded with the base member.

* * * * *